US007156202B2

(12) United States Patent
Assad

(10) Patent No.: US 7,156,202 B2
(45) Date of Patent: Jan. 2, 2007

(54) METHOD AND APPARATUS FOR VENTING EXHAUST GAS FROM AN ENGINE

(75) Inventor: Abdul S. Assad, Mesa, AZ (US)

(73) Assignee: MTD Products Inc, Valley City, OH (US)

( * ) Notice: Subject to any disclaimer, the term of this patent is extended or adjusted under 35 U.S.C. 154(b) by 414 days.

(21) Appl. No.: 10/818,284

(22) Filed: Apr. 5, 2004

(65) Prior Publication Data

US 2005/0217931 A1 Oct. 6, 2005

(51) Int. Cl.
*F01N 1/02* (2006.01)
*F01N 3/02* (2006.01)
*F01N 1/14* (2006.01)

(52) U.S. Cl. ..... 181/258

(58) Field of Classification Search ..... 181/258, 181/231, 269, 272, 282
See application file for complete search history.

(56) References Cited

U.S. PATENT DOCUMENTS 1,439,506 A * 12/1922 Ludwig ..... 181/263
1,794,276 A * 2/1931 Bowes ..... 181/262
2,229,386 A * 1/1941 Newton ..... 181/262
2,264,765 A * 12/1941 Le Veque ..... 181/262
3,857,458 A * 12/1974 Ohtani et al. ..... 181/262
3,968,854 A * 7/1976 Gordon et al. ..... 181/269
4,142,607 A * 3/1979 Landwehr et al. ..... 181/259
4,147,230 A * 4/1979 Ormond et al. ..... 181/231
4,265,332 A * 5/1981 Presnall et al. ..... 181/211
4,456,091 A 6/1984 Blanchot
4,487,289 A * 12/1984 Kicinski et al. ..... 181/252
4,579,195 A 4/1986 Nieri
4,867,270 A 9/1989 Wissmann et al.
4,890,690 A 1/1990 Fischer et al.
5,168,132 A 12/1992 Beidl et al.
5,315,075 A 5/1994 Junginger et al.
5,431,013 A 7/1995 Yamaki et al.
5,451,728 A 9/1995 Chandler et al.
5,498,842 A 3/1996 Karlsson
5,521,339 A 5/1996 Despain et al.
5,736,690 A 4/1998 Karlsson
5,738,184 A * 4/1998 Masuda et al. ..... 181/262
5,866,859 A 2/1999 Karlsson et al.
5,902,971 A * 5/1999 Sato et al. ..... 181/262
5,959,262 A 9/1999 Menzel
5,996,732 A 12/1999 Burger et al.
6,164,066 A 12/2000 Sakaguchi et al.
6,341,662 B1 1/2002 Karlsson
6,393,835 B1 5/2002 Stoll et al.

(Continued)

*Primary Examiner*—Edgardo San Martin
(74) *Attorney, Agent, or Firm*—Wegman, Hessler & Vanderburg

(57) ABSTRACT

A muffler for coupling to an exhaust port of an internal combustion engine. The muffler includes a housing having an exhaust inlet configured to receive exhaust gas from the engine, at least one internal expansion chamber and an outlet opening. The muffler further includes a diffuser cover attached to the housing over the exhaust opening of the housing forming an exhaust outlet of the muffler. The diffuser cover forms a trap chamber, a restricted throat and an ejector portion. The ejector portion is configured to draw in ambient air through an air inlet to cool the exhaust gas as it passes through the exhaust outlet. The restricted throat is positioned downstream from said trap chamber and has a smaller cross-sectional area than said trap chamber so as to increases the velocity of the exhaust gas as the exhaust gas passes through the restricted throat and into the ejector portion so as to aid in drawing in ambient air.

16 Claims, 3 Drawing Sheets

U.S. PATENT DOCUMENTS 6,422,338 B1 7/2002 Menzel et al.
6,591,606 B1 * 7/2003 Rosskamp et al. ..... 60/302
6,742,623 B1 * 6/2004 Tajima et al. ..... 181/269
6,789,644 B1 * 9/2004 Mukaida ..... 181/272
6,837,335 B1 * 1/2005 Jankowski ..... 181/243
6,955,043 B1 * 10/2005 Schlossarczyk et al. ..... 60/299
7,051,524 B1 * 5/2006 Kraft ..... 60/324
2001/0037912 A1 11/2001 Menzel
2003/0085072 A1 5/2003 Mukaida
2003/0141143 A1 * 7/2003 Jankowski ..... 181/217
2004/0154860 A1 * 8/2004 Joost et al. ..... 181/258

* cited by examiner

METHOD AND APPARATUS FOR VENTING EXHAUST GAS FROM AN ENGINE

BACKGROUND OF THE INVENTION

1. Field of Invention

The invention relates to mufflers for internal combustion engines and, more particularly, to a catalyst muffler system with improved capability for cooling the exhaust gas stream for an internal combustion engine used on portable tools such as air blowers, flexible line trimmers, edgers, chain saws, and the like.

2. Description of Related Art

Portable tools such as air blowers, flexible line trimmers, edgers, chain saws, and the like are commonly used and becoming more prevalent as people seek the convenience provided by such tools. It is widely appreciated that such tools can emit exhaust that increase air pollution. Typically the exhaust gas is energy rich, especially for small two-stroke engines, as complete burning of the fuel is not obtained. To curb the problem, regulations requiring increasingly low exhaust emission output levels have been passed.

It is known to use catalytic converters in a muffler for a small internal combustion engine used on portable tools to reduce noxious components of exhaust gas, such as hydrocarbons and carbon monoxide. An exothermal chemical conversion takes place in the catalytic converter where, for example, hydrocarbons are converted to carbon dioxide and water. The exhaust gas typically enters the muffler with a temperature of approximately 600 degrees centigrade (C.). Burning the unburnt hydrocarbons causes the temperature of the exhaust gas to increase in the catalytic converter 40 to about 1000 degrees C.

The high temperature of exhaust gas has several identifiable problems. With hand-held portable tools, operating personnel can be endangered by both high temperature exhaust gas and ignition of exhaust gas. The exhaust gas can ignite if it reaches ambient air containing oxygen, through the exhaust outlet or through a gap at a partition interface of the muffler housing, at temperatures high enough for ignition.

Accordingly, there is a need for a compact and light weight muffler for a small internal combustion engine having a relatively low exhaust emission output level and relatively low exhaust gas stream exit temperature and muffler housing surface temperature. Additionally, the muffler should provide good noise reduction, maintain good engine performance, and be reliable, inexpensive, and easy to manufacture.

SUMMARY OF THE INVENTION

This invention provides an exhaust system that effectively cools the exhaust gas as the exhaust gas leaves the muffler; an exhaust system that draws in ambient air to cool the exhaust gas; and an exhaust system that is economical to manufacture. In one aspect, the invention is a muffler for coupling to an exhaust port of an internal combustion engine. The muffler includes a housing forming at least one internal expansion chamber configured to receive exhaust gas from the engine and an exhaust outlet. The exhaust outlet has a restricted throat and an ejector portion, wherein the ejector portion is configured to draw in ambient air through an air inlet to cool the exhaust gas. The restricted throat increases the velocity of the exhaust gas as the exhaust gas passes through the restricted throat and into the ejector portion so as to aid in drawing in ambient air.

In another aspect, the invention is a muffler for coupling to an exhaust port of an internal combustion engine. The muffler includes a housing forming, the housing having an exhaust inlet configured to receive exhaust gas from the engine, at least one internal expansion chamber and an outlet opening. The muffler further includes a diffuser cover attached to the housing over the outlet opening in the housing and forming an exhaust outlet of the muffler. The diffuser cover comprises a trap chamber, a restricted throat and an ejector portion, the ejector portion configured to draw in ambient air through an air inlet to cool the exhaust gas as it passes through the exhaust outlet. The restricted throat is positioned downstream from the trap chamber and has a smaller cross-sectional area than said trap chamber so as to increases the velocity of the exhaust gas as the exhaust gas passes through the restricted throat and into the ejector portion so as to aid in drawing in ambient air.

In yet another aspect, the invention is a muffler for coupling to an exhaust port of an internal combustion engine. The muffler includes a housing having an exhaust inlet configured to receive exhaust gas from said engine, at least one internal expansion chamber and an outlet opening. The muffler further includes a diffuser cover attached to the housing over the outlet opening in the housing and forming an exhaust outlet of the muffler. The diffuser cover includes means for drawing in ambient air into the exhaust gas to cool the exhaust gas as it passes through the exhaust outlet, and means for increasing the velocity of the exhaust gas as the exhaust gas passes into the ejector means so as to aid in drawing in ambient air.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail with reference to the following figures, wherein.

Corresponding reference characters indicate corresponding parts throughout the views of the drawings.

DETAILED DESCRIPTION OF EXEMPLARY EMBODIMENTS

Figure 1:
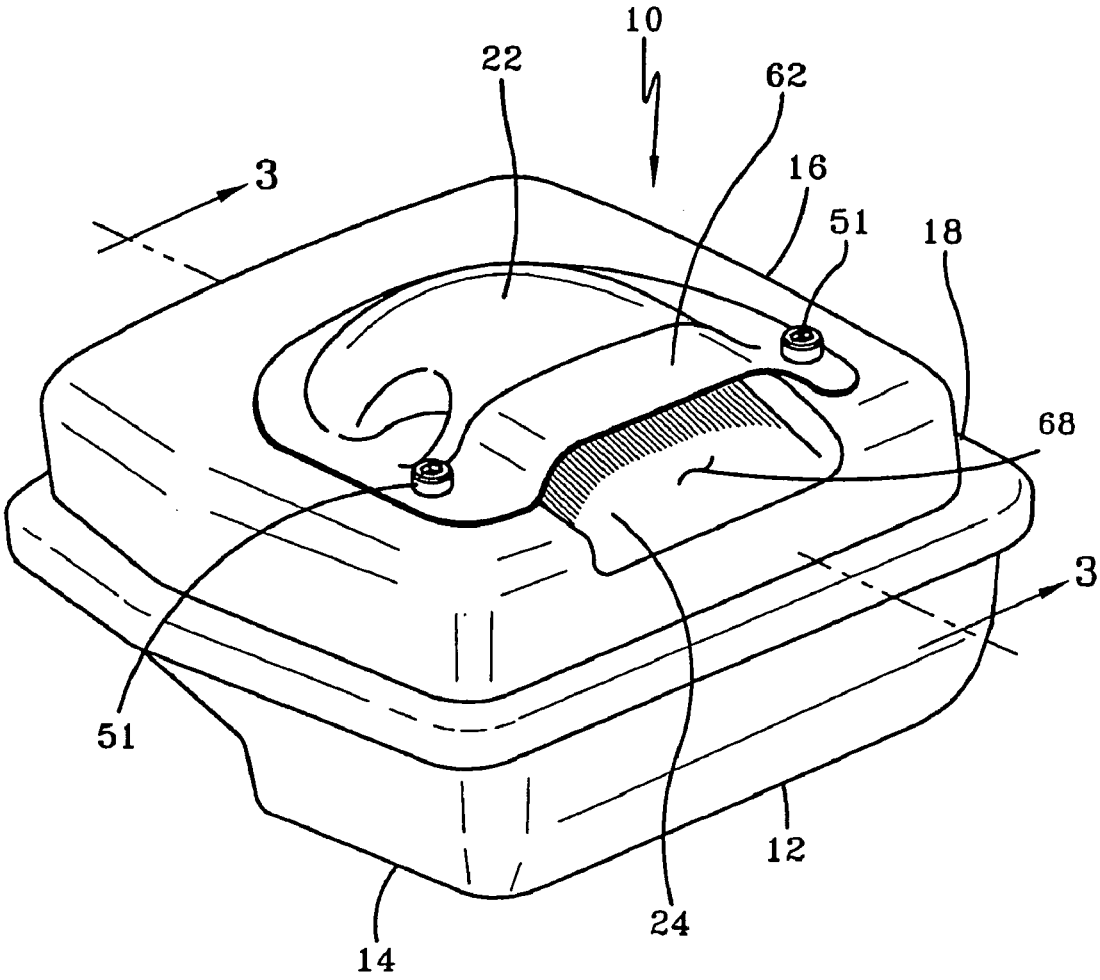
FIG. 1 illustrates a perspective view of an exhaust system used with a combustion engine on a portable tool.

The invention will now be described with reference to the drawings, wherein the drawings are for purposes of illustrating at least one embodiment of the invention and not for purposes of limiting the same. FIG. 1 illustrates an exhaust gas muffler, broadly and exhaust system, generally indicated at 10. The exhaust system 10 includes a muffler housing 12 preferably formed from two sections, namely an inlet housing section 14 and an outlet housing section 16. The inlet housing section 14 and outlet housing section 16 of the muffler housing 12 are suitably fastened or clamped together with a flange connection 18 along the peripheral edge of the two sections to form a sealed housing. An exhaust gas intake 20 (shown in FIGS. 2 and 3) connecting to a gas exhaust outlet (not shown) of a 2 cycle or a 4 cycle engine for a hand-held power tool is provided in the inlet housing section 14. Meanwhile, a diffuser cover 22 is fixedly attached to the outlet housing section 16 of the housing 12 and forms an exhaust outlet 24 as will be more fully described below.

Figure 2:
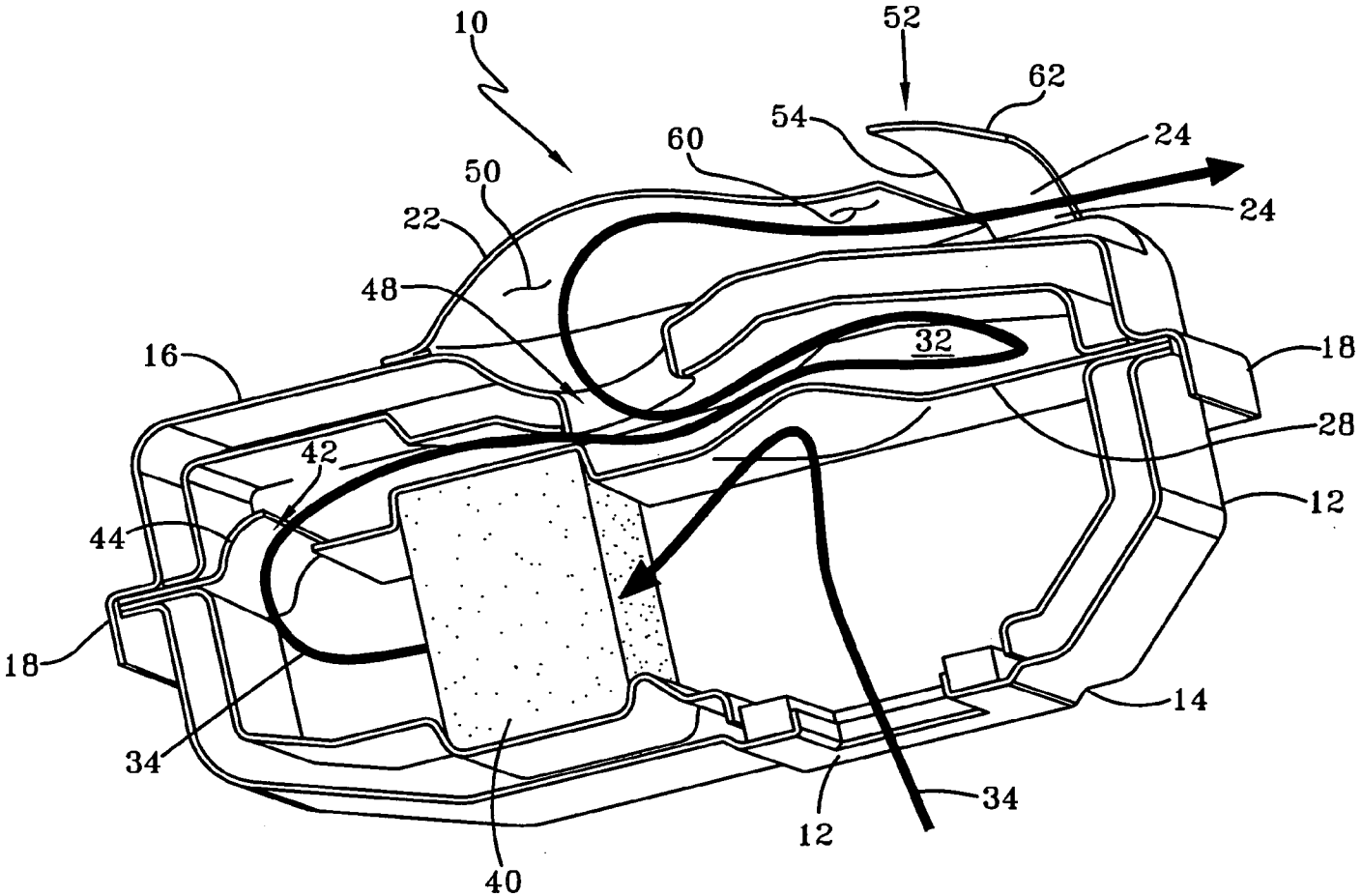
FIG. 2 is a cutaway view of the exhaust system of FIG. 1 showing the exhaust gas pathway through the exhaust system.
Figure 3:
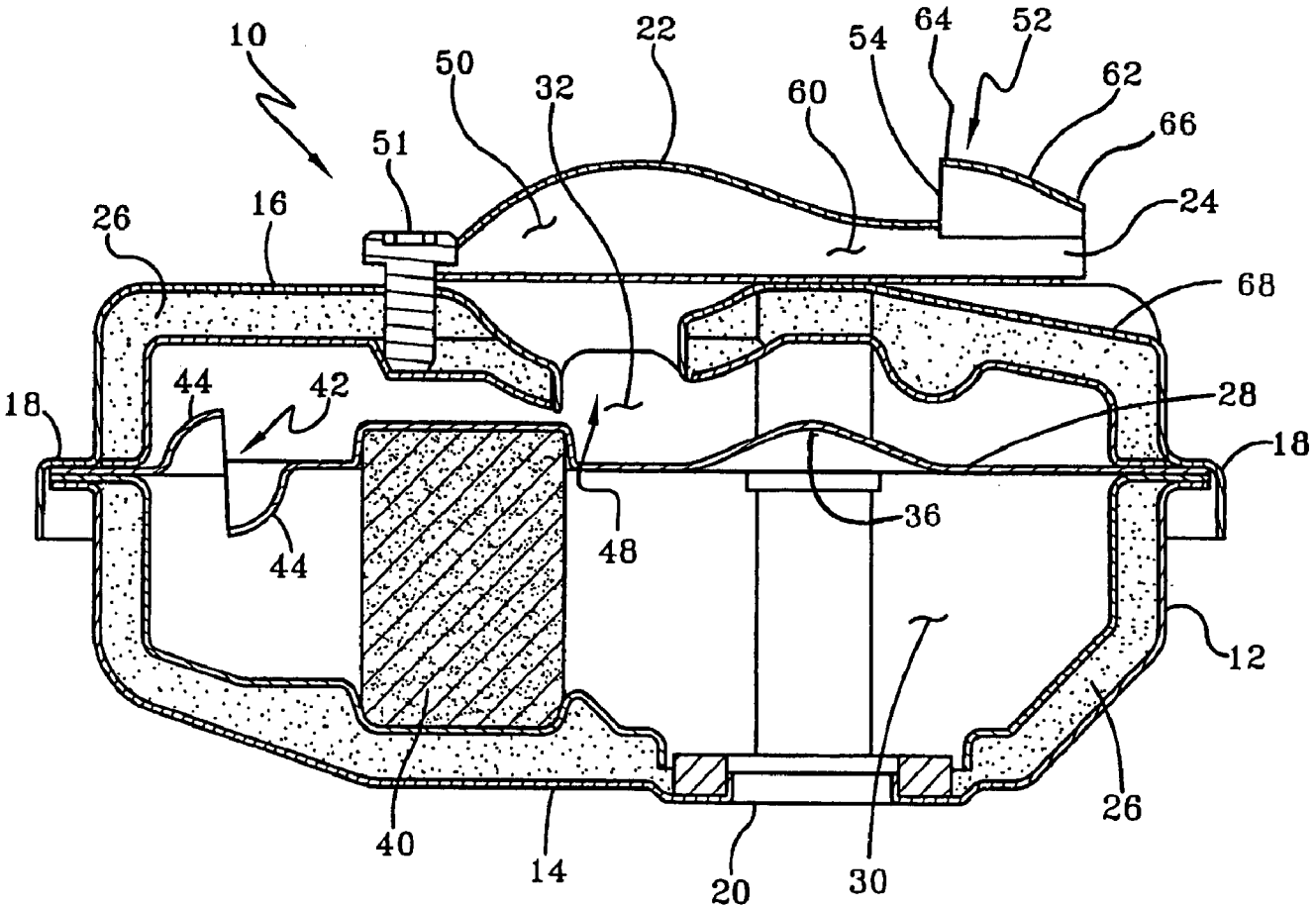
FIG. 3 is a cross-section view of the exhaust system taken along line 3—3 of FIG. 1.

With reference now to FIGS. 2 and 3, the interior of the muffler housing 12 is divided with a partition 28 extending transversely to the inflow direction of the exhaust gas thereby forming a first expansion chamber 30 and a second expansion chamber 32 within the muffler housing 12. The exhaust gas intake 20 is in fluid connection with the first expansion chamber 30. Exhaust flow line 34 illustrated in FIG. 2 shows the path of the exhaust from the engine (not shown) as it travels into the exhaust gas intake 20. The exhaust gas enters the first expansion chamber 30 and strikes an arched indentation 36 in the partition 28.

In one embodiment, it is possible to construct the outer circumference of the muffler housing 12 with double wall construction as shown in FIGS. 2 and 3. Heat insulating material 26 is packed between the double walls as shown. The heat insulating material 26 can be selected from a group of the heat insulating materials, such as alumina, glass wool, ceramic wool, mineral fiber, and the like. The double wall construction enhances the heat insulating efficiency of the muffler 10 and reduces the radiation of heat toward the outside of the muffler.

The exhaust gas then flows through a catalytic converter 40 located in the first expansion chamber 30. The catalytic converter 40 is suitably made of stainless steel and is coated with a catalyst such as platinum or rhodium, or other suitable catalyst. The catalytic converter 40 is provided with a plurality of honeycomb-like through holes (not shown) to permit the exhaust gas to pass through and come in contact with the catalyst. As the use of catalytic converters 40 in mufflers is well known to those skilled in the art, further description will not be provided herein. Furthermore, the inlet housing section 14 and outlet housing section 16 may be detachably connected so that the catalytic converter 40 can be removed for replacement or cleaning. Of course, one will understand that the use of a catalytic converter 40 is not essential and the muffler can be used without a catalytic converter.

The first and second expansion chambers 30, 32 are in fluid connection via an aperture 42 in the partition 28 that enables the exhaust gas stream to flow from the first expansion chamber 30 to the second expansion chamber 32 after passing through the catalytic converter 40. The aperture 42 may comprise a single larger opening as shown in FIG. 2 or a plurality of smaller opening (not shown) in the partition 28. In one embodiment, guide flanges 44 direct the exhaust gas stream through the aperture 42. The circuitous path through the second expansion chamber 32 aids in the cooling process of the exhaust gas.

From the second expansion chamber 32, the exhaust gas stream passes through an opening 48 in the outlet housing section 16. As illustrated, the diffuser cover 22 is attached to the housing 12 over a portion of the outlet housing section 16 such that a trap chamber 50 is formed by the diffuser cover 22 over the opening. As shown, the chamber 50 is a dome-shaped chamber, although other shapes may be used without departing from the scope of the invention. The diffuser cover 22 is made of a suitable heat resistive material such as aluminized steel, stainless steel or the like, and is fastened to the housing 12 with fasteners 51, although other means for fastening the diffuser cover 22 to the housing 12, such as by welding, riveting, clamping and the like are contemplated without departing from the scope of the invention. Alternately, the diffuser cover 22 can be formed as an integral piece with the outlet housing section 16 using a suitable stamping or molding process.

Turning now to the inventive features of the muffler 10, the diffuser cover 22 further comprises an ejector portion 52 having an air inlet 54 and the exhaust outlet 24. A restricted throat or venturi, indicated at 60, leads from the trap chamber 50 to the ejector portion 52. By restricted throat 60, it is meant that the exhaust gas travels through a passageway which has a smaller cross-sectional area than that of the trap chamber 50 or that of the exhaust outlet 24. The smaller cross-section provided by the restricted throat 60 causes an increase in the velocity of flow of the exhaust gas stream through the throat and a corresponding decrease in pressure. From the restricted throat 60, the exhaust gas stream, now traveling at the greater velocity, flows into the ejector portion 52. As a consequence of the exhaust gas stream flowing at a higher velocity into the ejector portion 52, an ejector effect is formed by means of which ambient air is drawn into the exhaust gas stream through the air inlet 54 opening in the diffuser cover 22. This drawn-in air mixes with the exhaust gas thereby significantly reducing the temperature of the exhaust gas that is discharged from the muffler 10. The design of the restricted throat 60 causes the exhaust gas stream to have a higher velocity entering the ejector portion 52, thereby creating a greater influx of ambient air, which in turn, provides an increased cooling effect on the exhaust gas.

The ejector portion 52 includes a louver 62 wherein a first edge 64 of the louver forms the air inlet 54 and a second, opposite edge 66 of the louver forms the exhaust outlet 24. As shown, the louver 62 has an arch shape at the air inlet 54 and is sloped downward to form a nozzle directing exhaust outlet 24. The exhaust gas stream is directed away from the muffler 10 through a sloped channel 68 in the outlet housing section 16.

In one embodiment, the restricted throat 60 is formed by the contour of the diffuser cover 22 and the outer surface of the outlet housing section 16. The restricted throat 60 suitably has a cross-sectional area of less than 0.750 square inches (4.8 $cm^2$), more desirably less than 0.400 square inches (2.6 $cm^2$), and preferably less than 0.200 square inches (1.3 $cm^2$), however other sizes are contemplated. In one embodiment, the restricted throat 60 is generally rectangular in shape and has a width of about 1.0 inch (2.5 cm) and a height of about 0.120 inches (0.305 cm). The rectangular shape of the restricted throat 60 desirably spreads out the exhaust gas to encourage mixing with the ambient air. In one embodiment, to be used for exemplary purposes only and not by way of limitation, the exhaust gas stream passes through the muffler at a rate of about 340 liters per minute and the restricted throat 60 and ejector portion 52 are sized to draw in about 2 liters of ambient air per minute through the air inlet. It has been found that drawing in and mixing ambient air with the exhaust gas is sufficient to cool the exhaust gas stream to a temperature less than 475° F. (246° C.) in an exhaust plane one inch (2.5 cm) from the exhaust outlet 24.

The diffuser cover 22 can be rotated with respect to the outlet housing section 16 depending on the configuration of the portable tool and the desired direction of the exhaust gas stream discharge. For example, mufflers 10 for use with air blowers may have a different configuration and desired exhaust outlet 24 direction than mufflers for use with string trimmers.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A muffler for coupling to an exhaust port of an internal combustion engine, said muffler comprising a housing forming at least one internal expansion chamber configured to receive exhaust gas from said engine and directing the exhaust gas to an exhaust outlet, the muffler having a trap chamber, a restricted throat having a cross-sectional area smaller than a cross-sectional area of the trap chamber and positioned downstream from the trap chamber such that the exhaust gas flows into the trap chamber and then out of the trap chamber through the restricted throat, and an ejector portion downstream from the restricted throat, the ejector portion being configured to draw in ambient air through an air inlet to cool the exhaust gas as the exhaust gas passes through the exhaust outlet, wherein the restricted throat increases the velocity of the exhaust gas as it enters the ejector portion so as to aid in drawing in ambient air.

2. The muffler according to claim 1 further comprising a diffuser cover attached to the housing, said diffuser cover forming the restricted neck and ejector portion.

3. The muffler according to claim 2 wherein the diffuser cover forms the trap chamber upstream from said restricted throat.

4. The muffler according to claim 3 wherein the restricted throat has a cross-sectional area less than about 0.750 square inches.

5. The muffler according to claim 4 wherein the ejector portion comprises a louver, wherein a first edge of the louver forms the air inlet and a second edge of the louver forms the exhaust outlet.

6. The muffler according to claim 3 wherein the trap chamber is a dome-shaped chamber.

7. The muffler according to claim 1 further comprising a catalytic converter positioned in said expansion chamber.

8. The muffler according to claim 2 wherein the diffuser plate is fastened to the housing over an exhaust opening in the housing.

9. A muffler for coupling to an exhaust port of an internal combustion engine, said muffler comprising:

a housing having an exhaust inlet configured to receive exhaust gas from said engine, at least one internal expansion chamber and an outlet opening; and a diffuser cover attached to the housing over the outlet opening in the housing and forming an exhaust outlet of the muffler, the diffuser cover comprising a trap chamber, a restricted throat and an ejector portion, the ejector portion configured to draw in ambient air through an air inlet to cool the exhaust gas as it passes through the exhaust outlet, wherein the restricted throat is positioned downstream from said trap chamber and has a smaller cross-sectional area than said trap chamber so as to increases the velocity of the exhaust gas as the exhaust gas passes through the restricted throat and into the ejector portion so as to aid in drawing in ambient air.

10. The muffler according to claim 9 wherein the restricted throat has a cross-sectional area less than about 0.750 square inches.

11. The muffler according to claim 9 wherein the ejector portion comprises a louver, wherein a first edge of the louver forms the air inlet and a second edge of the louver forms the exhaust outlet.

12. The muffler according to claim 9 wherein the trap chamber is a dome-shaped chamber.

13. The muffler according to claim 9 further comprising a catalytic converter positioned in said expansion chamber.

14. A muffler for coupling to an exhaust port of an internal combustion engine, said muffler comprising:

a housing having an exhaust inlet configured to receive exhaust gas from said engine, at least one internal expansion chamber and an outlet opening; and a diffuser cover attached to the housing over the outlet opening in the housing and forming an exhaust outlet of the muffler, wherein the diffuser cover comprises:

means for drawing in ambient air into the exhaust gas to cool the exhaust gas as it passes through the exhaust outlet; and means for increasing the velocity of the exhaust gas as the exhaust gas passes into the ejector means so as to aid in drawing in ambient air.

15. The muffler according to claim 14 wherein the means for increasing the velocity of the exhaust gas includes a restricted throat having a cross-sectional area less than about 0.750 square inches.

16. The muffler according to claim 14 wherein the means for drawing in ambient air includes a louver, wherein a first edge of the louver forms the air inlet and a second edge of the louver forms the exhaust outlet.

* * * * *